United States Patent [19]

Mathes

[11] B 3,991,273

[45] Nov. 9, 1976

[54] SPEECH COMPONENT CODED MULTIPLEX CARRIER WAVE TRANSMISSION

[75] Inventor: Robert C. Mathes, Maplewood, N.J.

[73] Assignee: Bell Telephone Laboratories, Incorporated, Murray Hill, N.J.

[22] Filed: Oct. 4, 1943

[21] Appl. No.: 504,899

[44] Published under the second Trial Voluntary Protest Program on March 9, 1976 as document No. B 504,899.

[52] U.S. Cl. ..... 179/1.5 FS; 179/1.5 R

[51] Int. Cl.[2] ..... H04K 1/04

[58] Field of Search ..... 250/9.28, 17.410; 179/15.3, 171.5–171.13, 1.5 R, 1.5 FS, 15 BM, 15 FD

[56] References Cited

UNITED STATES PATENTS

| | | | |
|---|---|---|---|
| 1,447,204 | 3/1923 | Espenschied | 250/9.28 |
| 1,565,521 | 12/1925 | Stone et al. | 250/9.28 |
| 1,629,685 | 5/1927 | Ditcham | 250/17.43 |
| 1,819,508 | 8/1931 | Hansell | 250/17.43 |
| 2,103,847 | 12/1937 | Hansell | 179/15.3 |
| 2,233,183 | 2/1941 | Roder | 250/9.28 |
| 2,270,385 | 1/1942 | Skillman | 179/171.5 |

*Primary Examiner*—Richard A. Farley
*Assistant Examiner*—H. A. Birmiel
*Attorney, Agent, or Firm*—H. A. Burgess

EXEMPLARY CLAIM

1. In a secret telephone transmission system in which speech waves are analyzed into component speech-defining low frequency signals which are coded in stepped wave form, a group of frequency modulators of the same type and same average frequency, means to impress said signals of stepped wave form on the respective frequency modulators to produce a plurality of frequency modulated waves of the same average frequency, and means to translate said last waves into frequency modulated waves accurately positioned at different frequency levels comprising a separate amplitude modulator for shifting the frequency of each such frequency modulated wave, and means to supply to said amplitude modulators carrier waves of accurately spaced frequency comprising a source of base frequency waves of highly constant frequency and a harmonic generator for fixing the frequencies of said supplied carrier waves.

1 Claim, 2 Drawing Figures

INVENTOR
R. C. MATHES
BY
H. A. Burgess

SPEECH COMPONENT CODED MULTIPLEX CARRIER WAVE TRANSMISSION

The present invention relates to multiplex carrier transmission using frequency modulation in the individual channels, and in particular to improving the relative frequency stability of these channels.

Although in its broader aspects the invention may be practised with various types of multiplex signaling systems, it will be disclosed herein as embodied in a telephone system using a system for analyzing and synthesizing speech of the type generally disclosed and claimed in H. W. Dudley U.S. Pat. No. 2,151,091 patented Mar. 21, 1939 but in which, for purposes of secrecy, signal distoring circuits are used in the individual channels into which the speech has been analyzed. The disclosure further shows how in accordance with a feature of the invention these channels as a group can be transmitted over long links such as transoceanic radio links with maintenance of precise frequency relations in the signal components throughout the entire system.

Figure 1:
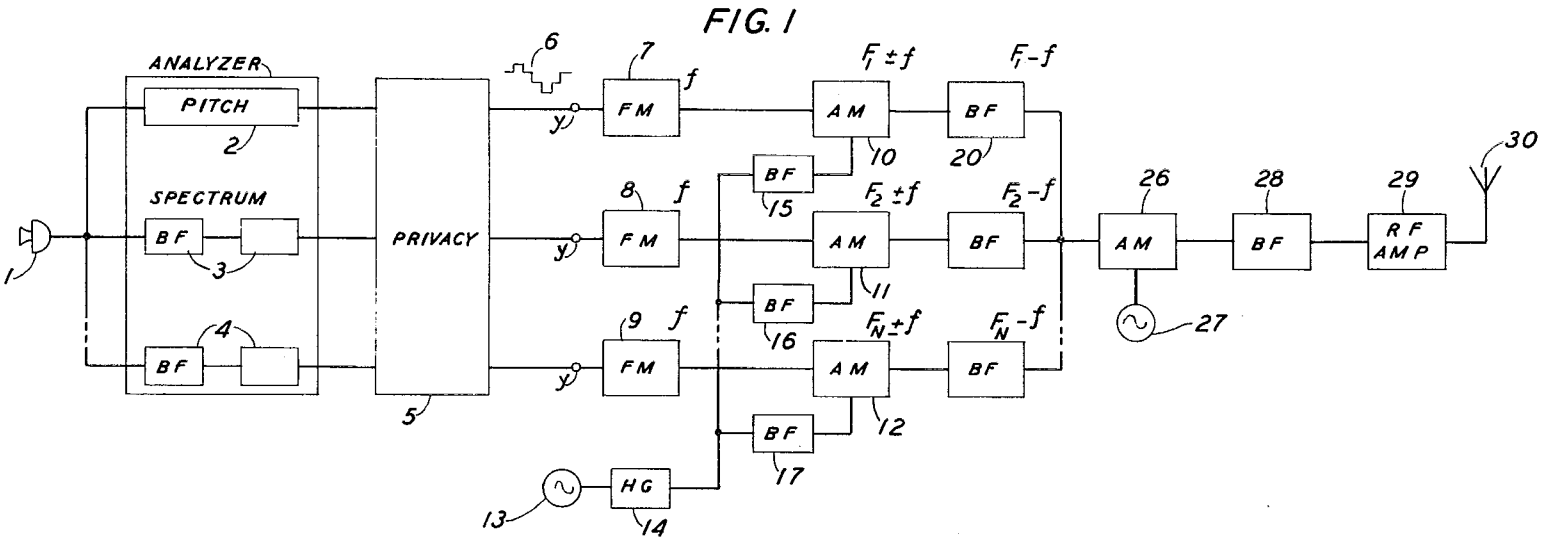
Figure 2:
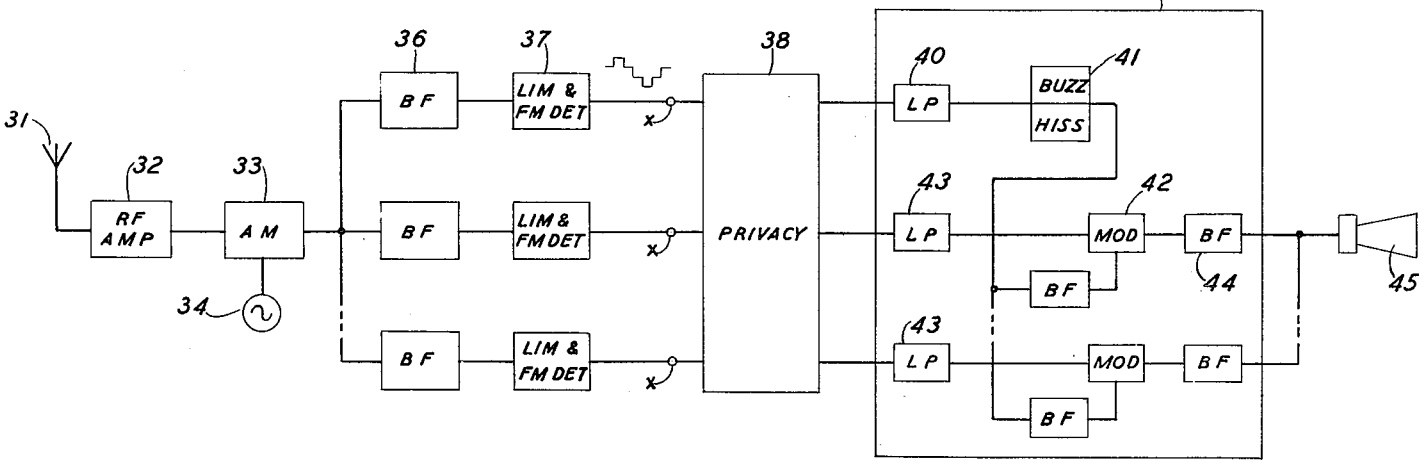

The various objects and features of the invention will appear more fully from the following detailed description in connection with the accompanying drawing in which:

FIG. 1 shows in single line block schematic diagram a radio transmitting terminal; and FIG. 2 a radio receiving terminal, in accordance with the invention.

Referring to FIG. 1, speech waves from microphone 1 or other input source are first analyzed to derive a pitch-defining current and a number (such as ten) of spectrum-defining currents, the former being sometimes referred to as frequency pattern and the latter as amplitude pattern currents. There may be more than one pitch channel and any number of spectrum channels. In this figure for illustration a single pitch channel is indicated, the analyzer part of which is shown at 2, and may be of the type shown in the Dudley patent or other suitable and known type for deriving a slowly varying current the amplitude of which from instant to instant is a measure of the fundamental pitch frequency of the speaker's voice. The spectrum channels each include a band-pass filter and integrating circuit 3 or 4 for deriving a slowly varying current the amplitude of which from instant to instant is a measure of the energy content of a small frequency band of the speech, the width of the band being determined by the pass band of the analyzer filter. These pass bands may be suitably chosen, as in the Dudley patent disclosure by way of example.

The privacy 5 is assumed to distort or mask each of the individual channel currents in any desired manner to disguise them, as by adding secret key currents to them and, in the process, produce abruptly stepped currents as indicated diagrammatically at 6. One manner of producing coded currents of this type is disclosed in my prior application for patent Ser. No. 412,054 filed Sept. 24, 1941 for Secret Telephony, and a further means for producing such coded currents is disclosed in an application of A. A. Lundstrom and L. G. Schimpf, Ser. No. 456,322, filed Aug. 27, 1942 for Secret Transmission of Intelligence.

Since it is necessary to transmit all of the vocoder channel currents to the distant receiver as separate and distinct signals, it is necessary to provide a suitable type of multiplex transmission for them, for example, by modulating each of them on a separate carrier frequency. In my prior application disclosure and also in the Lundstrom-Schimpf disclosure this is done by frequency modulating a series of carrier waves of different normal frequencies in modulators 7, 8 and 9. These waves may have any suitable frequencies, such as in the neighborhood of 1,000 to 3,000 cycles using preferably large swings of frequency amounting to several per cent each way from their mean frequencies. Because of the use of the stepped waves and of reentry in coding and decoding the signals, it is necessary to provide a high degree of accuracy in the modulation steps, such as an accuracy of one carrier wave cycle, for example.

Considerable difficulty has been found in practice in meeting this requirement as to accuracy. The present invention has, however, enabled the required degree of accuracy to be realized by using frequency modulators of one type all operating at the same mean fequency and then stepping the frequencies of the modulated waves to desired frequency levels by amplitude modulation of fixed carrier frequencies.

Accordingly, the frequency modulators 7, 8, 9 are of identical type and operate at the same mean frequency $f$. The modulated frequency bands are fed into amplitude modulators 10, 11 and 12, respectively, where they are shifted to different frequency positions indicated as $F_1 \pm f$, $F_2 \pm f$ and $F_n \pm f$. The $F_1$, $F_2$ and $F_n$ frequencies are supplied from a very accurately controlled base frequency source 13, such as a crystal controlled oscillator, temperature compensated where necessary, followed by a harmonic generator 14 the output of which leads through selecting filters 15, 16 and 17 to the modulators 10, 11 and 12, respectively. Alternatively, these harmonics may be supplied as a group to separate oscillators connected to respective modulators 10, etc., such as to hold the nominal frequencies of these oscillators accurately in step with the harmonic frequencies as disclosed in Phelps U.S. Pat. No. 2,314,422, Mar. 23, 1943. Band filters 20 select one side-band only of the output modulated waves so that the frequencies allowed to be transmitted are $F_1 - f$, $F_2 - f$ to $F_n - f$.

The output of these band filters is applied to the input of amplitude modulator 26 supplied with radio carrier from source 27 and the resulting output is amplified at 29 and radiated from 30. A band-pass filter 28 may be inserted to allow but one side-band to be transmitted if frequency range is to be conserved, or to allow the carrier and but one side-band to be transmitted, if desired.

The waves so transmitted are received on antenna 31 of FIG. 2 amplified at 32 and heterodyned at 33 with the aid of local source 34 of beat frequency waves. This stage could be a detector if the carrier wave were allowed to be transmitted. The individual channels are separated by band filters 36 and applied to individual amplitude limiter and frequency modulation detector circuits 37 for recovering the stepped, coded low frequency channel currents which are applied to the receiving privacy 38 for decoding. This privacy circuit is the counterpart of privacy circuit 5 and recovers the slowly varying currents which define the pitch and spectrum variations of the original speech. These are applied to a speech synthesizer of the type more fully disclosed in the Dudley patent for reconstructing understandable speech. The pitch-defining currents pass through filter 40 to the buzz-hiss source 41 for controlling the supply of electrical waves representing vocal chord type or unvoiced type sound waves to the modulators 42 of the individual spectrum channels, where they are modulated by the spectrum-defining currents from individual low-pass filters 43 in the different channels. Each modulator receives its particular band of frequencies from the source 41 and the resulting output waves are selected by filters 44 to build up a speech band and apply it to speaker 45, representative of any suitable receiving and sound producing output.

In some cases of long distance transmission, it may be desirable to divide such long paths into shorter paths connected in tandem by radio repeaters. In such cases, the receiving part of such a radio repeater could advantageously be the portion of the circuit of FIG. 2 up to the junction points indicated at *x* and the transmitting part could be the portion of the circuit of FIG. 1 after the junction points indicated at *y*. In other words, terminal points *x* in FIG. 2 would be directly connected to points *y* of FIG. 1 omitting the later appearing elements of FIG. 2 and the earlier appearing elements of FIG. 1.

Where steppers are used as in the Lundstrom-Schimpf disclosure, this would mean that the outputs of the receiving steppers would (without applying them to the receiving reentry circuits for deciphering) be directly carried over into the transmitting circuits to replace the outputs of the output steppers where they go into the inputs of the individual channel frequency modulators 7, 8, 9. It is seen that in such a repeater most of the regular terminal equipment is by-passed, including all filters involving considerable delay except the low-pass filters (not shown) that may be used in the output sides of the frequency modulation detectors 37. No key equipment would be needed and no synchronization except such control of the stepper timing currents as could be readily supplied with the aid of an adjustable phase shifter in the supply circuit. The message would be secret in passing through the repeater point. Alternatively, the transmission could be monitored by leaving the receiver intact, with the inputs to the privacy 38 bridged across the xy connecting points if the repeater point were provided with a key identical with that being used by the two terminal stations.

What is claimed is:

1. In a secret telephone transmission system in which speech waves are analyzed into component speech-defining low frequency signals which are coded in stepped wave form, a group of frequency modulators of the same type and same average frequency, means to impress said signals of stepped wave form on the respective frequency modulators to produce a plurality of frequency modulated waves of the same average frequency, and means to translate said last waves into frequency modulated waves accurately positioned at different frequency levels comprising a separate amplitude modulator for shifting the frequency of each such frequency modulated wave, and means to supply to said amplitude modulators carrier waves of accurately spaced frequency comprising a source of base frequency waves of highly constant frequency and a harmonic generator for fixing the frequencies of said supplied carrier waves.

* * * * *